US007575186B2

(12) United States Patent
Roessler

(10) Patent No.: US 7,575,186 B2
(45) Date of Patent: Aug. 18, 2009

(54) COMMINUTION MACHINE

(75) Inventor: Peter Roessler, Abstadt (DE)

(73) Assignee: Weima Maschinenbau GmbH, Ilsfeld (DE)

( * ) Notice: Subject to any disclaimer, the term of this patent is extended or adjusted under 35 U.S.C. 154(b) by 35 days.

(21) Appl. No.: 11/704,051

(22) Filed: Feb. 8, 2007

(65) Prior Publication Data

US 2007/0194160 A1 Aug. 23, 2007

(30) Foreign Application Priority Data

Feb. 18, 2006 (DE) ..... 10 2006 007 899

(51) Int. Cl.
*B02C 18/24* (2006.01)

(52) U.S. Cl. ..... 241/101.2; 241/242

(58) Field of Classification Search ..... 241/101.2, 241/242, 243
See application file for complete search history.

(56) References Cited

U.S. PATENT DOCUMENTS 3,735,217 A * 5/1973 Kilgore et al. ..... 318/100
3,844,184 A * 10/1974 Nelson et al. ..... 74/665 GA
4,208,620 A * 6/1980 Ringland ..... 318/111
4,572,442 A * 2/1986 Sigg ..... 241/117

FOREIGN PATENT DOCUMENTS

DE 10333359 1/2005

* cited by examiner

*Primary Examiner*—Mark Rosenbaum
(74) *Attorney, Agent, or Firm*—Factor & Lake, Ltd.

(57) ABSTRACT

A comminution machine for waste includes a rotor that carries blade elements and cooperates with counter-blades, which are fixed to the housing. The rotor is driven by a synchronous motor that is excited by a controllable frequency converter. In order to keep the connected power of the comminution machine small and nevertheless be able to apply a large torque to the rotor, the synchronous motor acts upon the rotor via a reduction gearing and a clutch.

11 Claims, 1 Drawing Sheet

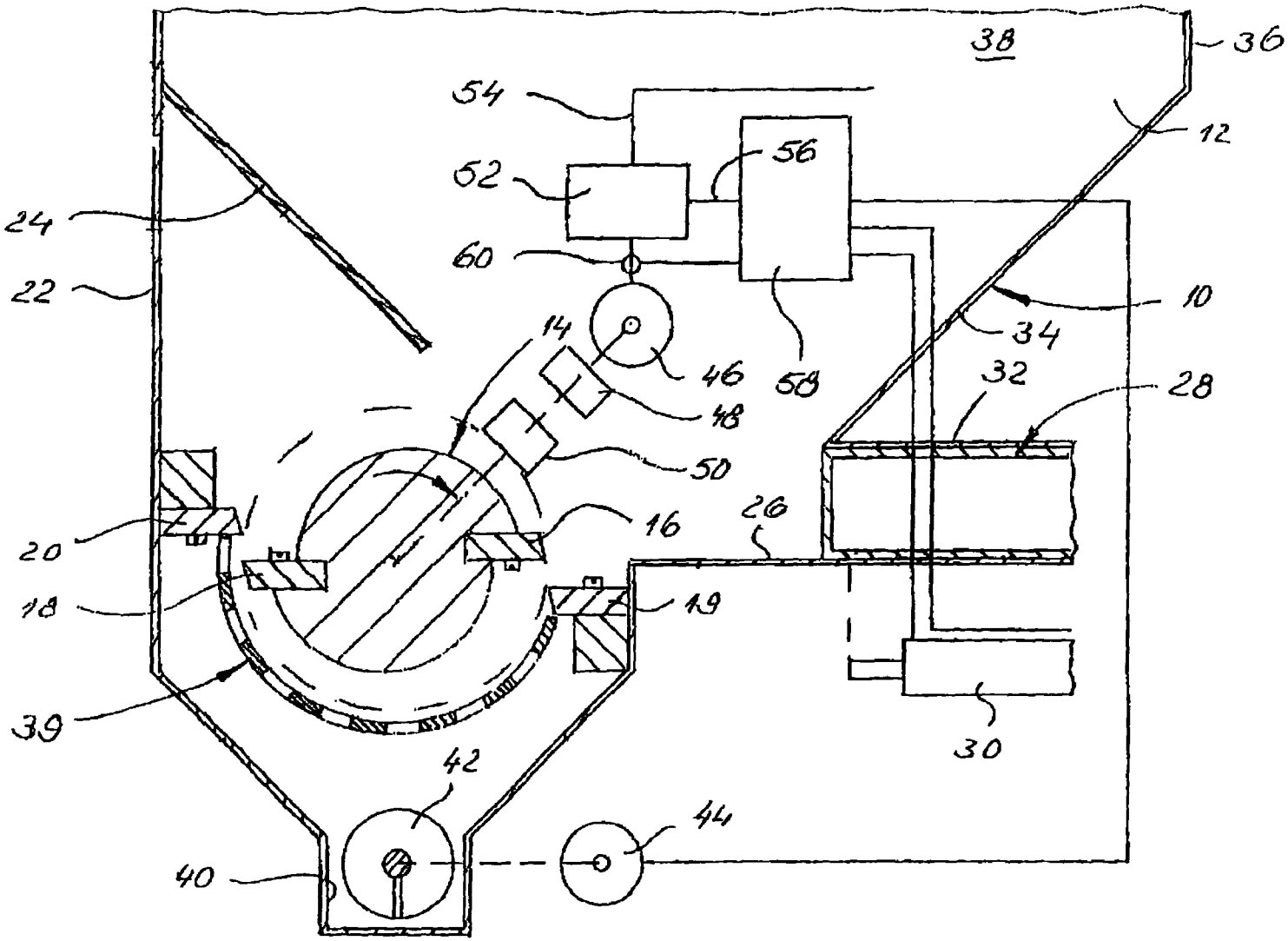
36
12
10
28
38
34
32
30
56
58
26
46
48
50
16
19
44
54
52
60
14
42
40
24
22
20
18
39

COMMINUTION MACHINE

RELATED APPLICATIONS

The present invention claims the benefit of the filing date of German Patent Application, Serial No. 10 2006 007 899.3, filed Feb. 18, 2006; the content of which is incorporated by reference herein.

TECHNICAL FIELD

The invention relates to a comminution machine.

BACKGROUND OF THE INVENTION

A known comminution machine is disclosed in German Patent DE 103 33 359 B3, wherein the synchronous motor is connected directly to the rotor shaft in a rotationally positive manner.

Owing to the electronic rotational-speed control of the rotor, the known comminution machine can be easily adapted to a variety of comminution conditions, such as those occurring in normal comminution material. It can operate with, on the one hand, a high torque, and, on the other hand, a high rotational speed.

When the known comminution machine is operating at low rotational speeds, in particular when it is working almost at a standstill against a very hard object in the comminution material, it requires a very large amount electric power. Correspondingly, powerful power-supply installations capable of providing some thousand A are available only at those locations where such an electric power consumption has already been allowed for at the planning stage.

Nowadays, however, comminution machines are increasingly being used at various locations for the purpose of breaking down waste into fragments that can then be conveyed as quasi-homogeneous material, possibly made into briquettes, transported, and processed further. Often, such locations do not have a powerful power-supply connection.

The present invention is provided to solve these and other problems.

SUMMARY OF THE INVENTION

The present invention is directed to a comminution machine such that, on the one hand, continues to have the advantageous characteristics of the speed-controllable drive whilst, on the other hand, can be operated with a power-supply connection such as that usually found at industrial workplaces, where connection powers of some hundred kW are to be expected.

More specifically, one embodiment of the present invention includes a comminution machine having a rotor which carries blade elements, and a counter-blade arrangement which is fixed to the frame and cooperates with the blade elements of the rotor. A synchronous motor acts upon the rotor and is excited by a feed unit whose frequency is controllable, wherein the synchronous motor acts upon the rotor via a reduction gearing.

In the case of the comminution machine according to the present invention, use is made of the fact that, in the comminution of waste, the high torque is normally used only for a short period, in order to comminute particularly hard components in the comminution material. According to the invention, this torque can be provided by a synchronous motor which is smaller than that of the prior art, and which acts upon the rotor via a reduction gearing. With the use of a reduction gearing having a transmission ratio of 4:1, it is thus possible to use a synchronous motor which provides only a quarter of the maximum torque of a synchronous motor which, being connected directly to the rotor, has to provide the same torque. Correspondingly, less electric power is required by the synchronous motor.

Under operating conditions other than those of the comminution of very hard objects, the difference between the comminution machine according to the present invention and the comminution machine according to the prior art can be compensated by having the synchronous motor of the comminution machine run at a frequency which is increased according to the reduction ratio of the gearing. This is possible using the frequency converters used for operating synchronous motors, with the power drawn from the power supply remaining within the limits—since under these conditions the comminution machine is not working against a hard object.

The comminution machine according to the present invention can thus be characterized in that, in the case of comminution material of normal toughness, it operates at a rotor rotational speed which is the same as that of the known comminution machine, but it manages with a smaller synchronous motor and a lesser connected power. In the provision of high torque, however, it benefits from the reduction gearing.

The use of a smaller synchronous motor has the further advantage that the latter costs less, and also presents fewer cooling problems.

Another aspect of the present invention—if the reduction gearing used is a V-belt drive—includes the drive having a certain inherent elasticity between the input shaft and the output shaft. Such gearings are also available at low cost, with a transmission ratio that can be selected within wide limits. Similar advantages are offered by a chain drive, wherein the drive is suitable for the transmission of yet greater forces and torques.

A further aspect of the present invention includes a toothed-wheel gearing that is advantageous in respect to the compactness of the dimensions of the gearing.

If a planetary gearing is used, particularly good reduction ratios can be realized with a compact gearing structure.

Yet another aspect of the present invention involves the reduction gearing including a hydrodynamic gearing, wherein a high reduction ratio with a compact structure of the reduction gearing is provided.

A still further aspect of the present invention includes a clutch disposed in the drive train between the synchronous motor and the rotor to provide a situation in which, upon the occurrence of very high resistances in the comminution material, the drive train between the synchronous motor and the rotor is interrupted before mechanical damage can occur therein.

In yet another aspect of the present invention, the clutch is disposed between the reduction gearing and the rotor, wherein damage to the gearing resulting from inertia can be avoided.

Yet another further aspect of the present invention includes various preferred forms for clutches—jaw clutch, friction clutch, coaxial sleeve clutch, or hydraulic clutch—which serve to protect the drive train. The sleeve clutch is partially advantageous due to its compact structure.

These and other objects and advantages will be made apparent from the following brief description of the drawings and the detailed description of the invention.

BRIEF DESCRIPTION OF THE DRAWINGS

The invention is explained more fully in the following with reference to an exemplary embodiment and the drawing. In the drawing, the sole FIGURE shows the schematic representation of a comminution machine.

DETAILED DESCRIPTION OF THE INVENTION

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

The comminution machine represented in the drawing has a housing, denoted in its entirety by 10, which is welded together from thick, appropriately edged sheet-steel parts.

A comminuting cylinder, denoted in its entirety by 14, is mounted on side walls 12 of the housing by means of bearings, which are not shown. The said comminuting cylinder carries strip-type blade elements 16, 18, which cooperate with likewise strip-type counter-blades 19, 20, which are fixed to the housing.

A side wall 22, which is on the left in the drawing, carries a guide wall 24 which is inclined obliquely downwards.

A feed slider 28 can be displaced over a base wall 26, said feed slider being realized as a hollow box part and being movable back and forth by a double-action working cylinder 30. Its top side cooperates with a protective wall 32, which is connected to a housing wall 34 that is on the right in the drawing. The lateral walls of the feed slider 28 run in front of the side walls 12, with a small amount of play.

An end wall 36 of the housing 10 adjoining the upper end of the wall 34 constitutes the final part of the enclosure of a provisioning space 38 into which the material to be comminuted is fed.

Disposed between the counter-blades 19, 20 is a partial-cylinder-shaped hole-type sieve 39, which is located outside of the path of the tips of the blade elements 16, 18, said path being indicated by a broken line. Cut pieces falling through the hole-type sieve 39 are directed downwards, by obliquely inclined lower hopper walls, to a collecting channel 40, in which there runs a conveyor worm 42. A worm drive 44 is assigned to said conveyor worm.

A synchronous motor 46, which acts upon the comminuting cylinder 14 via a reduction gearing 48 and a releasable clutch 50, is provided to rotate the comminuting cylinder 14.

The synchronous motor 46 can be controlled, in its rotational speed, through the frequency of the supply voltage fed to it. It is fed by means of a frequency converter 52, whose frequency can be controlled and which is connected to the public 50 Hz power supply network via a power-supply line 54.

A control line 56 connects the frequency converter 52 to a control unit 58 of the comminution machine.

Via the control line 56, the frequency converter 52 receives a setpoint value for the starting frequency to be set.

A current sensor 60 measures the current flowing in the feed line of the synchronous motor 46. The control circuit 56 can identify, on the basis of the output signal of the current sensor 60, the load against which the comminuting cylinder 14 is working.

If the current measured by the current sensor 60 exceeds a predefined maximally permissible value, the control line 56 stops the synchronous motor 44 and then drives it in the reverse direction for a predefined period of time. Hard components in the comminution material that have become wedged between the blade elements 16, 18 and the counter-blades 19, 20 are thereby released again, and normally become differently orientated, such that, upon subsequent resumption of motion of the comminuting cylinder 14 in the correct direction, denoted by an arrow in the drawing, different cutting conditions are obtained in the cutting gaps constituted by the blade elements 16, 18 and the counter-blades 19, 20, and the hard components in the comminution material can then nevertheless be broken or cut.

If the control unit 58 finds that the comminuting power provided by the comminuting cylinder 14 is below a predefined setpoint value, it drives a working cylinder 62 in such a way that comminution material that has slipped out of the provisioning space 32 is pressed against the comminuting cylinder 14 by said working cylinder.

Since the synchronous motor 46 acts upon the comminuting cylinder 14 via the reduction gearing 48, a very large torque can be applied to said cylinder, and it can also comminute very hard material between the blade elements 16, 18 and the counter-blades 19, 20, despite the fact that the synchronous motor 44 does not require an extremely large connected power. In practice, the synchronous motor 44 can have a connected power in the order of magnitude range of 100 kW, as is normally readily available in industrial operating locations.

A variety of gearings are conceivable for the reduction gearing 48, depending on the specific type of application: V-belt gearing, chain gearing, toothed-wheel gearing, in particular planetary gearing, and also hydraulic gearing. The reduction gearing 48 may also be a series connection of the various gearings mentioned above.

If the comminuting cylinder 14 has rotated relatively rapidly in the comminution of normal comminution material and a large piece of metal comes briefly into the comminuting gap, the comminuting cylinder 14 is stopped abruptly. The clutch 50 is provided in order to preclude damage to the reduction gearing 48 in the case of such abrupt loads. This clutch may be one which operates with form closure, e.g. a jaw clutch, a clutch operating by friction, or a hydraulic clutch.

In respect of the structural size, the preference in this case is for a sleeve clutch having a sleeve-shaped inner clutch part and a sleeve-shaped outer clutch part which surrounds the inner clutch part with very little radial play. The inner sleeve-shaped clutch part is hollow, and has a circumferential wall which is slightly deformable radially. Upon application of pressure to its interior, the inner clutch part frictionally grips the outer clutch part. If the pressure in the interior of the inner clutch part is relieved, the two clutch parts can be rotated relative to each other.

Since a very small radial deformation of the inner clutch part is sufficient to produce the frictional closure with the outer clutch part, likewise only a very small quantity of fluid need be drawn out of the interior of the inner clutch part in order to re-release the clutch. The clutch thus also separates particularly rapidly.

It should be emphasized that the above-described embodiments of the present invention, particularly, any "preferred" embodiments, are possible examples of implementations merely set forth for a clear understanding of the principles of the invention. Many variations and modifications may be made to the above-described embodiments of the invention without substantially departing from the spirit and principles of the invention. All such modifications are intended to be included herein within the scope of this disclosure and the present invention, and protected by the following claims.

The invention claimed is:

1. A comminution machine having a rotor which carries blade elements, having a counter-blade arrangement which is fixed to the frame and cooperates with the blade elements of the rotor, and having a synchronous motor which acts upon the rotor and is excited by a feed unit whose frequency is controllable, wherein the synchronous motor acts upon the rotor via a reduction gearing wherein a clutch is disposed between the reduction gearing and the rotor.

2. A comminution machine according to claim 1, wherein the reduction gearing comprises a V-belt drive.

3. A comminution machine according to claim 1, wherein the reduction gearing comprises a chain drive.

4. A comminution machine according to claim 1, wherein the reduction gearing comprises a toothed-wheel gearing.

5. A comminution machine according to claim 4, wherein the toothed-wheel gearing comprises a planetary gearing.

6. A comminution machine according to claim 1, wherein the reduction gearing comprises a hydrodynamic gearing.

7. A comminution machine according to claim 1, wherein the clutch is disposed in the drive train between the synchronous motor and the rotor.

8. A comminution machine according to claim 7, wherein the clutch has a jaw clutch, a friction clutch, a coaxial sleeve clutch, or a hydraulic clutch.

9. A comminution machine according to claim 1, wherein the clutch has a jaw clutch, a friction clutch, a coaxial sleeve clutch, or a hydraulic clutch.

10. A comminution machine having a rotor which carries blade elements, having a counter-blade arrangement, which is fixed to the frame and cooperates with the blade elements of the rotor, and having a synchronous motor which acts upon the rotor and is excited by a feed unit whose frequency is controllable, wherein the synchronous motor acts upon the rotor via a reduction gearing, wherein a clutch is disposed between the reduction gearing and the rotor and wherein the clutch has a friction clutch or a hydraulic clutch.

11. A comminution machine having a rotor which carries blade elements, having a counter-blade arrangement which is fixed to the frame and cooperates with the blade elements of the rotor, and having a synchronous motor which acts upon the rotor and is excited by a feed unit whose frequency is controllable, wherein the synchronous motor acts upon the rotor via a reduction gearing, and wherein a clutch is disposed between the reduction gearing and the rotor, and further wherein the reduction gearing comprises one of a V-belt drive, a chain drive, or a toothed-wheel gearing, or a planetary gearing.

* * * * *